US008163110B2

(12) United States Patent
Aoyagi et al.

(10) Patent No.: US 8,163,110 B2
(45) Date of Patent: Apr. 24, 2012

(54) SUPERFINE COPPER ALLOY WIRE AND METHOD FOR MANUFACTURING SAME

(75) Inventors: Taikan Aoyagi, Hitachi (JP); Ryohei Okada, Hitachi (JP); Hiromitsu Kuroda, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 1035 days.

(21) Appl. No.: 12/078,939

(22) Filed: Apr. 8, 2008

(65) Prior Publication Data

US 2008/0202648 A1 Aug. 28, 2008

Related U.S. Application Data

(62) Division of application No. 11/052,226, filed on Feb. 8, 2005, now abandoned.

(30) Foreign Application Priority Data

May 24, 2004 (JP) ..... 2004-153304

(51) Int. Cl.
*C22C 1/08* (2006.01)

(52) U.S. Cl. ..... 148/554; 148/684; 148/685

(58) Field of Classification Search ..... 148/554, 148/684, 685
See application file for complete search history.

(56) References Cited

U.S. PATENT DOCUMENTS

2003/0089518 A1 5/2003 Matsui et al.

FOREIGN PATENT DOCUMENTS

| | | | |
|---|---|---|---|
| JP | 63274796 | * | 11/1988 |
| JP | 6-287726 | | 10/1994 |
| JP | 6-287727 | | 10/1994 |
| JP | 6-287728 | | 10/1994 |
| JP | 6-287729 | | 10/1994 |
| JP | 11-293431 | | 10/1999 |
| JP | 2000-199042 | | 7/2000 |
| JP | 2000239766 | * | 9/2000 |
| JP | 2001-40439 | | 2/2001 |
| JP | 3325641 | | 7/2002 |

* cited by examiner

*Primary Examiner* — Sikyin Ip
(74) *Attorney, Agent, or Firm* — McGinn IP Law Group PLLC

(57) ABSTRACT

A superfine copper alloy wire has a copper-silver alloy wherein the superfine copper alloy wire has a final wire diameter of 0.05 mm or less, and the copper-silver alloy has a copper-silver eutectic crystal phase whose volume ratio to a whole volume of the superfine copper alloy wire is 3% or more and 20% or less.

9 Claims, 2 Drawing Sheets

SUPERFINE COPPER ALLOY WIRE AND METHOD FOR MANUFACTURING SAME

The present application is based on Japanese patent application No. 2004-153304, the entire contents of which are incorporated herein by reference.

The present application is a Divisional application of U.S. patent application Ser. No. 11/052,226, filed on Feb. 8, 2005, now abandoned.

BACKGROUND OF THE INVENTION

1. Field of the Invention

The present invention relates to a superfine copper alloy wire and the manufacturing method therefor, and particularly to a superfine copper alloy wire applied to signal lines for electronic equipment, electric power supply lines and the like.

2. Description of the Related Art

Excellent electric conductivity, strength, flexibility, and wire drawability are required for a superfine copper alloy wire which is wired for inputting/outputting signals to and from a compact electronic equipment or wired for supplying an electric power to such electronic equipment. Heretofore, a Cu—Sn base alloy wire or a Cu—Sn—In base alloy wire being excellent in strength has been employed.

Recently, there is a tendency for thinning a diameter of a conductor in superfine copper alloy wires. To suppress increase in resistance of a conductor accompanied with thinning the conductor, elevation of an electric conductivity in the conductor is desired. In addition, since a wire material becomes also easily broken with a small load, highly strengthening a conductor is required to avoid breaking of the wire material. As a copper alloy wire having a high strength and a high electric conductivity, a Cu—Ag base alloy wire is desired. An example of a method for manufacturing a Cu—Ag alloy wire includes the following methods:

(1) A method for obtaining a copper alloy wire having a high strength and a high electric conductivity wherein a cast rod of a Cu for 2 to 14% by weight Ag alloy is cold-worked and heat-treated. The heat treatment is carried out at a temperature of 400 to 600° C. for one to 100 hours (see Japanese patent application laid-open No. 2000-199042).

(2) A method for obtaining a copper alloy wire having a high strength and a high electric conductivity wherein an ingot of a Cu for 1 to 10% by weight Ag alloy is cold-worked and heat-treated. In this case, the heat treatment is conducted in two steps wherein the first step is conducted at a temperature of 700 to 950° C. for 0.5 to 5 hours, and the second step is conducted at a temperature of 250 to less than 400° C. for 0.5 to 40 hours (see Japanese patent No. 3325641).

(3) A method for obtaining a copper alloy wire having a high strength and a high electric conductivity wherein a copper alloy soft raw material of a Cu for 1.0 to 4.5% by weight Ag alloy is cold-worked and heat-treated. In this case, the heat treatment is conducted at a temperature of 300 to 550° C. for one second to thirty minutes (see Japanese patent application laid-open No. Hei 11-293431).

(4) A method for obtaining a copper alloy wire having a high strength and a high electric conductivity wherein a cast rod of a Cu for 1.0 to 15.0% by weight Ag alloy is cold-worked and heat-treated. In this case, the heat treatment is conducted at a temperature of 400 to 500° C. for 1 to 30 hours (see Japanese patent application laid-open No. 2001-40439).

Incidentally, when a wire diameter of any of the respective copper alloy wires obtained by the methods (1) to (4) mentioned above is made to be 0.008 to 0.05 mm in the form of a superfine wire, it is difficult to achieve both of a high tensile strength of 800 MPa or more and a high electric conductivity of 80% IACS or more.

SUMMARY OF THE INVENTION

It is an object of the present invention to provide a superfine copper alloy wire having both of a tensile strength of 800 MPa or more and an electric conductivity of 80% IACS or more and a manufacturing method therefor.

According to one aspect of the invention, a superfine copper alloy wire comprises:

a copper-silver alloy;

wherein the superfine copper alloy wire has a final wire diameter of 0.05 mm or less, and the copper-silver alloy comprises a copper-silver eutectic crystal phase whose volume ratio to a whole volume of the superfine copper alloy wire is 3% or more and 20% or less.

According to another aspect of the invention, a superfine copper alloy wire comprises:

a main wire body comprising a copper-silver alloy; and a silver film formed around the main wire body, wherein the superfine copper alloy wire has a final wire diameter of 0.05 mm or less, and the copper-silver alloy comprises a copper-silver eutectic crystal phase whose volume ratio to a whole volume of the superfine copper alloy wire is 3% or more and 20% or less.

It is further preferred that the volume ratio to the whole volume of the superfine copper alloy wire is 5% or more and 15% or less.

It is preferred that the copper alloy comprises a weight ratio of silver to copper that is 1.0 wt % or more and 3.5 wt % or less.

It is further preferred that the copper alloy comprises a weight ratio of silver to copper that is 1.5 wt % or more and 3.0 wt % or less.

It is preferred that the superfine copper alloy wire comprises a tensile strength of 800 MPa or more, and an electric conductivity of 80% IACS or more.

According to another aspect of the invention, a method for manufacturing a superfine copper alloy wire having a final wire diameter of 0.05 mm or less, comprises the steps of:

pouring a copper alloy hot metal prepared by allowing 1.0 wt % or more to 3.5 wt % or less of Ag to contain in a copper parent material having a total sum of 10 ppm or less of impurity concentrations into a casting mold to implement metal casting;

cooling an uncoagulated copper alloy hot metal after the pouring at a cooling rate of 400° C./min or more to 500° C./min or less to form a casting;

cold-working the casting for reducing a diameter thereof; and recrystallizing a wiredrawn material obtained as a result of the cold working.

It is preferred that the recrystallizing step comprises a heat treatment at a temperature of 300° C. or more to 550° C. or less for 0.5 to 20 hours.

It is preferred that the wiredrawn material after the heat treatment is quenched.

It is also preferred that the recrystallizing step comprises a rapid heating at a temperature of 600° C. or more to 900° C. or less for 5 to 120 seconds, and a quenching treatment is followed.

It is preferred that a silver plating is applied to the wiredrawn material after the recrystallizing step.

According to the present invention, there is an excellent advantageous effect for obtaining a superfine copper alloy wire having a high tensile strength and high electric conductivity.

BRIEF DESCRIPTION OF THE DRAWINGS

The present invention will be explained in more detail in conjunction with appended drawings, wherein.

DESCRIPTION OF THE PREFERRED EMBODIMENTS

Figure 1:
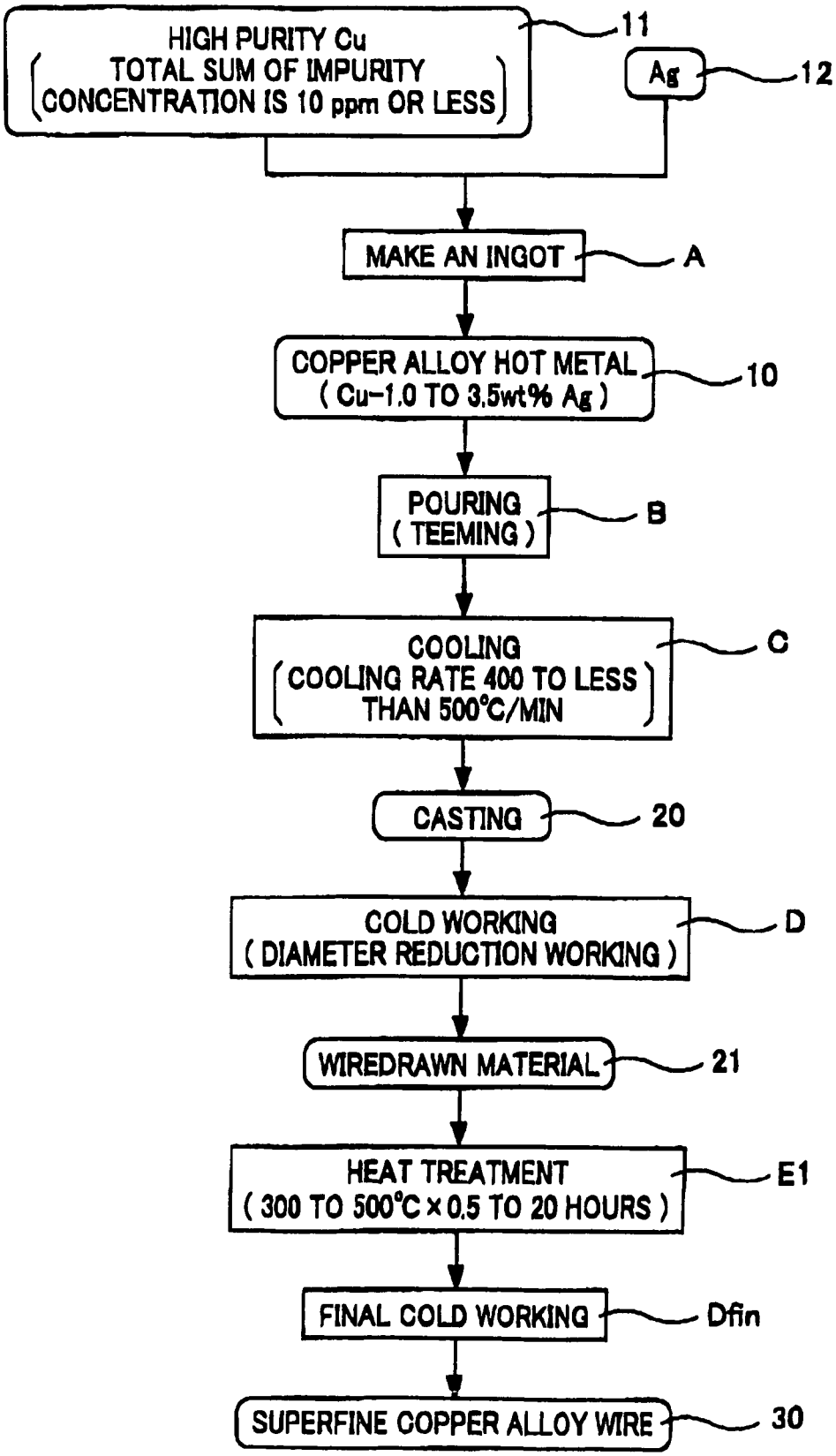
FIG. 1 is a flow chart showing a method for manufacturing a superfine copper alloy wire according to a preferred embodiment of the present invention.

A preferred embodiment of the present invention will be described in detail hereinafter.

A superfine copper alloy wire according to a preferred embodiment of the present invention has a final wire diameter of 0.05 mm or less, preferably 0.008 to 0.05 mm, and which is made from a copper alloy element having a chemical composition of Cu for 1.0 to 3.5 wt % Ag. A phase texture of the copper alloy element is composed in such that fibrous (filament-form) eutectic crystal phases of Cu and Ag are dispersed into a Cu matrix at a ratio of 3 to 20% with respect to the whole volume of a wire material. A superfine copper alloy wire of the present embodiment has a tensile strength of 800 MPa, preferably 840 to 1200 MPa, and an electric conductivity of 80% IACS or more, preferably 84% IACS or more.

In the present embodiment, the reason why an Ag concentration is selected to be within a range of from 1.0 to 3.5 wt % is in that when the Ag concentration exceeds 3.5 wt %, a volume ratio of eutectic crystal phases exceeds 20%, so that its electric conductivity decreases. On the other hand, when the Ag concentration is less than 1.0 wt %, a volume ratio of eutectic crystal phases of Cu and Ag becomes less than 3%, so that an effect for elevating strength becomes insufficient.

The reason for selecting a volume ratio of eutectic crystal phases of Cu and Ag is to be 3 to 20% is in that when the volume ratio exceeds 20%, a volume ratio of a Cu matrix itself decreases, so that its electric conductivity becomes less than 80% IACS, while when the volume ratio is less than 3%, an elevating effect for tensile strength becomes insufficient, resulting in less than 800 MPa.

The reason for selecting a tensile strength is to be 800 MPa and more, and preferably 840 MPa or more is in that substantially equal to or more than a tensile strength (about 850 MPa or more) of a Cu—Sn base superfine copper alloy wire which is used for compact equipment at the present day, for example, a probe cable for medical application and the like.

A superfine copper alloy wire according to the present embodiment may be used in the form of either a single wire material, or a twisted wire material obtained by twisting a plurality of the superfine copper alloy wires.

In the following, a method for manufacturing a superfine copper alloy wire of a preferred embodiment will be described with reference to the accompanying drawings.

As shown in FIG. 1, a method for manufacturing a superfine copper alloy wire 30 of a preferred embodiment is implemented through the following procedures.

First, casting is made to obtain an ingot with the use of a high-purity Cu (copper parent material) 11 wherein a sum total of impurity concentration is 10 ppm or less, preferably 5 ppm or less, and more preferably 1 ppm or less, and Ag 12 (step A), whereby a copper alloy hot metal 10 is prepared. The ingot is prepared by melting first the high-purity Cull, and then, adding the Ag 12 into the Cu hot metal. In case of making the ingot, each amount of the high-purity Cu 11 and the Ag 12 is adjusted in such that a chemical composition of them is Cu for 1.0 to 3.5 wt % Ag. Furthermore, it is preferred to melt the high-purity Cu 11 in a vacuum atmosphere, while it is preferred to melt the Ag 12 in an inert gas atmosphere, for example, an Ar gas atmosphere.

Then, the copper alloy hot melt 10 is poured in a casting mold to conduct metal casting (teeming) (step B). The uncoagulated copper alloy hot metal 10 after the pouring is cooled at a cooling rate of 400 to less than 500° C./min (step C) to form a casting 20. As a manner for casting, either of a continuous casting method or a batch casting method is applicable, but a continuous casting method is desirable, because its productivity is superior to that of the latter method.

Next, the casting 20 is subjected to cold working as a working for reducing its diameter at least one time (step D) to obtain a wiredrawn material 21, It is to be noted herein that the term "cold working" means collectively a variety of workings for reducing a diameter of a casting such as wire drawing, metal rolling, and swaging.

Then, the resulting wiredrawn material 21 is heat-treated at 300 to 350° C. for 10 to 20 hours, at 350 to 450° C. for 5 to 10 hours, or at 450 to 550° C. for 0.5 to 5 hours (step E1). Among these heat-treating conditions, the most preferable is the one at 50 to 450° C. for 5 to 10 hours. The wiredrawn material 21 after the heat treatment is subjected to quenching treatment. An example of the quenching treatment includes water-cooling and the like treatments. The heat treatment in the step E1 is preferably carried out in a batch type manner. For instance, when the wiredrawn material 21 taken up on a take-up drum is introduced into a heating oven or the like, the heat treatment in the step E1 is completed. Furthermore, it is preferred that the heat treatment is implemented in an inert gas atmosphere, e.g. an Ar gas atmosphere.

Finally, when the quenched wiredrawn material 21 is again subjected to cold working (final cold working) (step $D_{fin}$) to make a final wire diameter to be 0.05 mm or less, whereby the superfine copper alloy wire 30 is obtained.

In this case, an Ag concentration in the copper alloy hot metal 10 is 1.0 to 3.5 wt %, and this is equal to or less than its solid soluble limit, so that no eutectic crystal phase of Cu and Ag appears in a Cu matrix of the casting in the case when the uncoagulated copper alloy hot metal 10 is either slowly or rapidly cooled to from the casting. For this reason, it is required to cool the uncoagulated copper alloy hot metal 10 at a predetermined cooling rate.

In the manufacturing method of the present embodiment, a cooling rate in case of forming the casting 20 is adjusted to be within a range of from 400 to less than 500° C./min, and preferably within a range of from 400 to 480° C./min in the step C. As a result, even if an Ag concentration in the copper alloy hot metal 10 is within a range of from 1.0 to 3.5 wt % a value of which is that less than its solid soluble limit, eutectic crystal phases of Cu and Ag crystallize in a meshed form in the Cu matrix of the casting 20. A ratio of crystallization (volume fraction) of the eutectic crystal phases is to be 3 to 20% with respect to all the volume of the casting (wire material) 20. In the above-mentioned cooling rate range, the higher cooling rate can result in the smaller volume fraction of the eutectic crystal phases. For example, when a drawing rate of a continuous casting piece is adjusted in case of applying a continuous casting machine, a cooling rate can be adjusted wherein the higher drawing rate can bring about the faster cooling rate.

When the casting 20 is subjected to cold working to form the wiredrawn material 21, crystallized eutectic phases in a meshed form are stretched fibrously along the longitudinal direction of the wiredrawn material 21 to be dispersed as a reinforced fiber material of the Cu matrix. Due to the fiber reinforcing and the work hardening, a tensile strength of the wiredrawn material 21, and in addition, that of the superfine copper alloy wire 30 is remarkably elevated.

Furthermore, in the manufacturing method according to the present embodiment, the wiredrawn material 21 is heat-treated at a temperature of 300 to 550° C. for 0.5 to 20 hours in the step E1. Because of the heat treatment, Cu crystals in the wiredrawn material 21 are recrystallized to eliminate a processing strain. Besides, due to the heat treatment, Ag which is solid-solved in a Cu solid phase in the Cu matrix and the eutectic crystal phase of the wiredrawn material 21 is separated out, and at the same time, Cu which is solid-solved in an Ag solid phase in the eutectic crystal phase of the wiredrawn material 21 is separated out. Due to elimination of the processing strain, a stretch characteristic of the wiredrawn material becomes good, so that a reduction ratio can be improved in case of the following cold working. As a result of precipitation of Ag and Cu, an electrical conductivity of the wiredrawn material 21, and further, that of the superfine copper alloy wire 30 are elevated.

The reason for selecting a temperature of the heat treatment is to be within a range of from 300 to 550° C., when a temperature is less than 300° C., an effect for eliminating a processing strain in the wiredrawn material 21 becomes insufficient, while when a temperature exceeds 550° C., Ag precipitated phase and Cu precipitated phase are solid-solved again, so that an electric conductivity of the wiredrawn material 21, namely, that of the superfine copper alloy wire 30 is lowered. When a time for heat treatment is maintained at a constant value, the higher heat-treating temperature results in the higher amount of elimination in a processing strain (tensile strength decreases), and at the same time, resolution in solid-state of the Ag precipitated phase and the Cu precipitated phase proceeds (electric conductivity decreases). On one hand, when a heat-treating temperature is maintained at a constant value, the longer period of heat-treating time results in the higher elimination amount of a processing strain, besides, resolution in solid-state of the Ag precipitated phase and the Cu precipitated phase proceeds also.

Due to the matters as described above, the superfine copper alloy wire 30 according to the present embodiment can achieve both of a high tensile strength of 800 MPa or more and a high electric conductivity of 80% IACS or more in spite of the fact that an Ag concentration is as low as 1.0 to 3.5 wt %. Thus, the superfine copper alloy wire 30 of the present embodiment requires a less amount of expensive Ag, so that a superfine copper alloy wire having a high tensile strength and a high electric conductivity can be obtained relatively in an inexpensive cost.

Furthermore, since the superfine copper alloy wire 30 of the present embodiment has a high elongation of 1.1% or more, its flexibility is also good. Accordingly, the superfine copper alloy wire 30 of the present embodiment may be used as a superfine wire material for which elasticity is required.

In these circumstances, the superfine copper alloy wire 30 of the present embodiment may be suitably applied, for example, to a probe cable for medical use, supply lines or signal lines for mobile apparatuses, robots and the like.

In the following, another method for manufacturing a superfine copper alloy wire according to a preferred embodiment of the present invention will be described based on the accompanying drawings.

Figure 2:
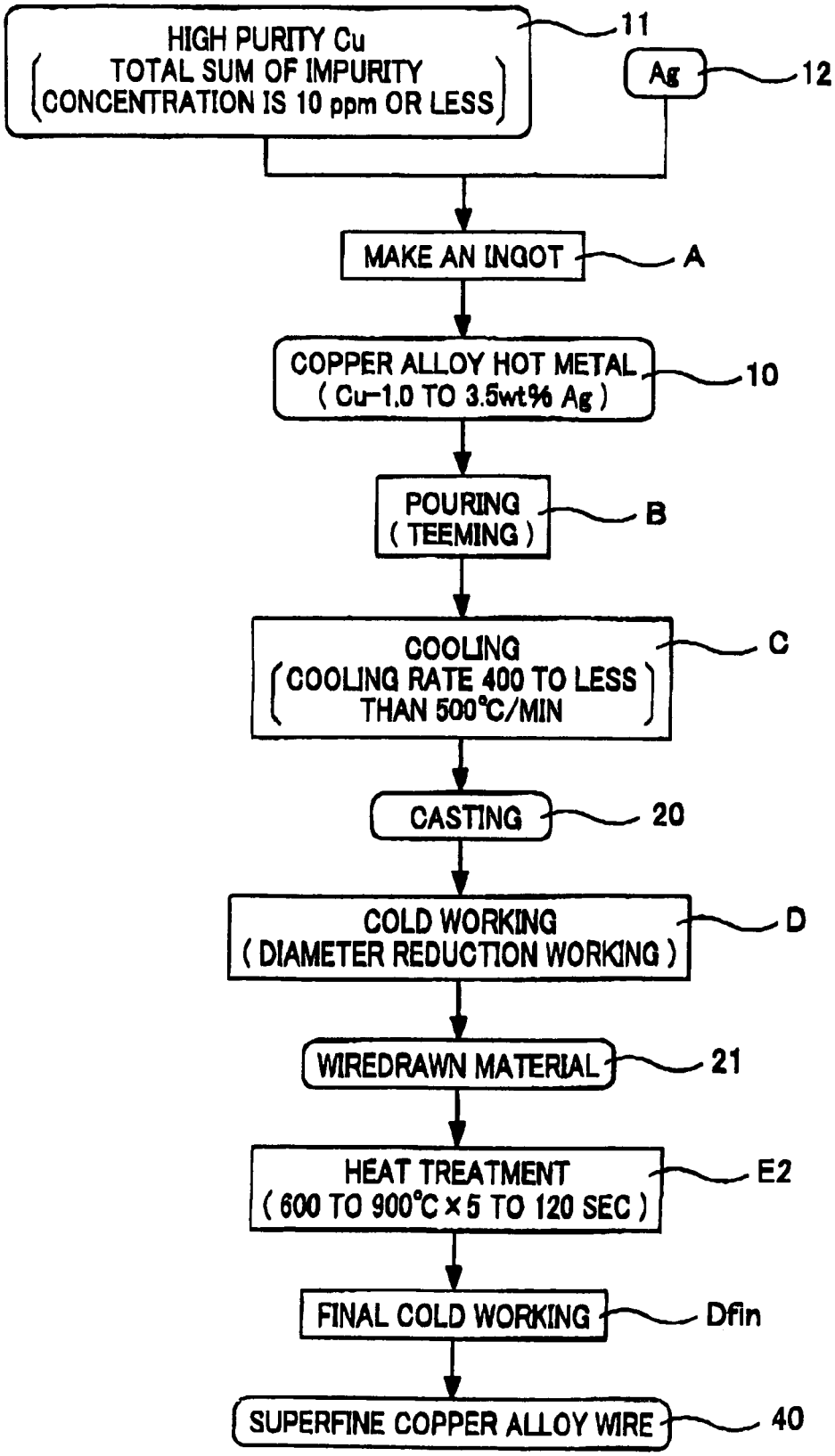
FIG. 2 is a flow chart showing a method for manufacturing a superfine copper alloy wire according to another preferred embodiment of the present invention.

As shown in FIG. 2, the method for manufacturing a superfine copper alloy wire of the present embodiment is the same as that of the method for manufacturing a superfine copper alloy wire of the former embodiment shown in FIG. 1 up to a step for forming a wiredrawn material 21. Hence, an explanation will start from a step for heat-treating the wiredrawn material 21 in the method for manufacturing a superfine copper alloy wire according to the present invention.

A heat treatment is applied to the wiredrawn material 21 which is in a state where it is traveled on a belt line at a temperature of from 600 to 900° C. for 5 to 120 seconds, preferably at a temperature of 700 to 900° C. for 5 to 80 seconds, and more preferably at a temperature of 750 to 850° C. for 5 to 40 seconds (step E2). The heat treatment is conducted by, for example, such a manner that the traveling wiredrawn material 21 is passed through a uniform heat zone (uniformly heating zone) a temperature of which is adjusted to be 600 to 900° C. A heating time may be arbitrarily adjusted by regulating a traveling speed of the wiredrawn material 21 and/or a length of the uniform heat zone. On one hand, the heat treatment may be implemented by energizing the traveling wiredrawn material 21 itself to heat it. In this case, a heating time may be arbitrarily selected by adjusting a traveling speed of the wiredrawn material 21 and/or a distance between electrodes for applying a voltage to the wiredrawn material. In addition, it is preferred that the heat treatment is carried out in an inert gas atmosphere such as Ar gas atmosphere.

Finally, the wiredrawn material 21 quenched is subjected to cold working again (final cold working) (step $D_{fin}$), whereby a final wire diameter is made to be 0.05 mm or less to obtain a superfine copper alloy wire 40 of the present embodiment.

In also the superfine copper alloy wire 40 prepared by the manufacturing method of the present embodiment, the same functions and advantageous effects as those of the superfine copper alloy wire 30 prepared by the manufacturing method of the former embodiment are obtained. Moreover, according to the manufacturing method of the present embodiment, it is possible to complete a heat treatment with respect to the wiredrawn material 21 in a very short period of time of 5 to 120 seconds, and accordingly, a better productivity can be realized in the method for manufacturing the superfine copper alloy wire 40 than that of the superfine copper alloy wire 30.

The superfine copper alloy wire 40 obtained by the manufacturing method according to the present embodiment is made from a copper alloy alone being the same as that of the superfine copper alloy wire 30 obtained by the manufacturing method according to the former embodiment. However, a layer structure of the superfine copper alloy wire 40 is not limited to a single-layer structure, but a structure of plural layers is also applicable. For example, an Ag film may be provided around a main body composed of a copper alloy a chemical composition of which is Cu for 1.0 to 3.5 wt % Ag. A film thickness of an Ag film is, for example, to be 1 to 10%, and preferably 3 to 6% with respect to a whole diameter of the superfine copper alloy wire.

Such formation of the Ag film is made, for example, after final cold working. More specifically, the wiredrawn material 21 quenched is subjected to a final cold working, and then an Ag plating process is applied to the wiredrawn material 21. In this case, a film thickness of a plating film is adjusted to obtain a final wire diameter of 0.05 mm or less. As a result, an Ag film is formed around the wiredrawn material 21 (main body section), whereby the superfine copper alloy wire 40 having a double-layer structure is obtained. Due to the formation of an Ag film, it becomes possible to improve further its electric conductivity while ensuring sufficiently a tensile strength in the superfine copper alloy wire 40.

The present invention is not limited to the above-mentioned preferred embodiments, but a variety of the other modifications may be applied as a matter of course.

In the following, the present invention will be described on the basis of examples. In this respect, it is to be noted that the invention is not limited to these examples.

EXAMPLES

Example 1

As a parent metal for manufacturing a copper alloy, a high-purity Cu wire material wherein a Cu content thereof is 99.9999 wt %, and a concentration of the total unavoidable impurities is 0.5 ppm was used.

A surface of the wire material was pickled, the interior of a high-purity graphite crucible, which was secured to the inside of a vacuum chamber, was charged with the resulting wire material, and vacuum melting of the high-purity Cu wire material was carried out. After the high-purity Cu wire material was completely solved, a vacuum atmosphere inside the chamber was replaced by an argon gas atmosphere. Thereafter, the interior of the high-purity graphite crucible was charged with a pure Ag wire material, and an ingot was prepared from a copper alloy hot metal. In this case, an amount of the pure Ag wire material to be charged was adjusted in such that a chemical composition of the copper alloy hot metal came to be Cu for 2.0 wt % Ag.

The resulting copper alloy hot metal was poured into a casting mold made of graphite in continuous casting equipment to conduct continuous casting of a rough drawing wire (casting) having 8.0 mm diameter. A cooling rate of the copper alloy hot metal was 450° C./min.

A primary wire drawing (reduction of area: about 89.4%) was applied to the resulting rough drawing wire to form a wiredrawn material, and then, a scalping treatment and an acid cleaning treatment were applied to the resulting wiredrawn material to obtain 2.6 mm diameter of the wiredrawn material. Thereafter, the wiredrawn material was heat-treated in such that it was heated up to 400° C. in an Ar gas atmosphere and maintained for 10 hours, then, it was quenched by cold water. The wiredrawn material after the heat treatment was subjected to a secondary wire drawing (reduction of area: about 99.9%) to prepare a superfine copper wire drawing having a diameter of 0.016 mm.

Example 2

The same copper alloy hot metal as that of example 1 was poured into a casting mold made of graphite in continuous casting equipment, and continuous casting was carried out to obtain a rough drawing wire (casting) having 8.0 mm diameter. A cooling rate of the copper alloy hot metal was 425° C./min.

A primary wire drawing (reduction of area: about 98.7%) was applied to the resulting rough drawing wire to form a wiredrawn material. Then, a scalping treatment and an acid cleaning treatment were applied to the wiredrawn material to obtain 0.9 mm diameter of the wiredrawn material. Thereafter, the resulting wiredrawn material was heat-treated in such that it was traveled through a uniform heat zone at 800° C. for 20 seconds in an Ar gas atmosphere. The wiredrawn material after the heat treatment was subjected to a secondary wire drawing (reduction of area: about 99.9%). Then, Ag-plating was applied to the resulting wiredrawn material to prepare a superfine copper alloy wire having 0.016 mm diameter.

Example 3

A copper alloy hot metal having a chemical composition of Cu for 1.5 wt % Ag was prepared in accordance with the same manner as that of example 1. The resulting copper alloy hot metal was poured into a casting mold made of graphite in continuous casting equipment, and continuous casting was carried out to obtain a rough drawing wire (casting) having 8.0 mm diameter. A cooling rate of the copper alloy hot metal was 450° C./min.

A primary wire drawing (reduction of area: about 98.7%) was applied to the resulting rough drawing wire to form a wiredrawn material, and then, a scalping treatment and an acid cleaning treatment were applied to the resulting wiredrawn material to obtain 0.9 mm diameter of the wiredrawn material. Thereafter, the wiredrawn material was heat-treated in such that it was heated up to 400° C. in an Ar gas atmosphere and maintained for 5 hours, then, it was quenched by cold water. The wiredrawn material after the heat treatment was subjected to a secondary wire drawing (reduction of area: about 99.9%) to prepare a superfine copper wire drawing having a diameter of 0.016 mm.

Example 4

A copper alloy hot metal having a chemical composition of Cu for 3.0 wt % Ag was prepared in accordance with the same manner as that of example 1. The resulting copper alloy hot metal was poured into a casting mold made of graphite in continuous casting equipment, and continuous casting was carried out to obtain a rough drawing wire (casting) having 8.0 mm diameter. A cooling rate of the copper alloy hot metal was 450° C./min.

Thereafter, a superfine copper alloy wire having 0.016 mm diameter was prepared in accordance with the same manner as that of example 3 other than that a heating temperature was 500° C. in case of the heat treatment.

Comparative Example 1

A copper alloy hot metal having a chemical composition of Cu for 0.4 wt % Ag was prepared in accordance with the same manner as that of example 1. The resulting copper alloy hot metal was poured into a casting mold made of graphite in continuous casting equipment, and continuous casting was carried out to obtain a rough drawing wire (casting) having 8.0 mm diameter. A cooling rate of the copper alloy hot metal was 450° C./min.

Thereafter, a superfine copper alloy wire having 0.016 mm diameter was prepared in accordance with the same manner as that of example 3 other than that a maintaining period of time was 10 hours in case of the heat treatment.

Comparative Example 2

A copper alloy hot metal having a chemical composition of Cu for 1.5 wt % Ag was prepared in accordance with the same manner as that of example 1. The resulting copper alloy hot metal was poured into a casting mold made of graphite in continuous casting equipment, and continuous casting was carried out to obtain a rough drawing wire (casting) having 8.0 mm diameter. A cooling rate of the copper alloy hot metal was 500° C./min.

Thereafter, a superfine copper alloy wire having 0.016 mm diameter was prepared in accordance with the same manner as that of example 3 other than that a maintaining period of time was 10 hours in case of the heat treatment.

Comparative Example 3

A copper alloy hot metal having a chemical composition of Cu for 5.0 wt % Ag was prepared in accordance with the same manner as that of example 1. The resulting copper alloy hot metal was poured into a casting mold made of graphite in continuous casting equipment, and continuous casting was carried out to obtain a rough drawing wire (casting) having 8.0 mm diameter. A cooling rate of the copper alloy hot metal was 450° C./min.

Thereafter, a superfine copper alloy wire having 0.016 mm diameter was prepared in accordance with the same manner as that of example 3 other than that a heating temperature was 450° C., and a maintaining period of time was 10 hours in case of the heat treatment.

With respect to the respective superfine copper alloy wires obtained in examples 1 to 4 and comparative examples 1 to 3, evaluations were made on items of volume ratio (%) of eutectic crystal phase occupying total volume of wire material, tensile strength (MPa), elongation (%), and electric conductivity (% IACS). These evaluated results are shown in Table 1.

TABLE 1

| | | Copper Alloy Composition | Cooling Rate . . . / min) | Volume Ratio of Eutectic Crystal phase (%) | Tensile Strength (Mpa) | Elongation (%) | Electric Conductivity (% IACS) |
|---|---|---|---|---|---|---|---|
| Example | 1 | Cu 2.0 wt % Ag | 450 | 10 | 850 | 1.2 | 86 |
| | 2 | Cu 2.0 wt % Ag | 425 | 12 | 900 | 1.3 | 84 |
| | 3 | Cu 1.5 wt % Ag | 450 | 5 | 840 | 1.5 | 90 |
| | 4 | Cu 3.0 wt % Ag | 450 | 15 | 1100 | 1.2 | 81 |
| Comparative | 1 | Cu 0.4 wt % Ag | 450 | 0 | 700 | 1.3 | 95 |
| Example | 2 | Cu 1.5 wt % Ag | 500 | 0.8 | 780 | 1.3 | 88 |
| | 3 | Cu 5.0 wt % Ag | 450 | 25 | 1300 | 1.0 | 72 |

As shown in Table 1, all the factors of an Ag concentration in a copper alloy composition, a cooling rate, and a volume ratio of eutectic crystal phases of the respective superfine copper alloy wires of examples 1 to 4 are adjusted to be within the respective ranges specified in these examples 1 to 4. Due to the conditions described above, all of the items indicate good results in such that a tensile strength ranges from 840 to 1100 MPa, an elongation ranges from 1.2 to 1.5%, and an electric conductivity ranges from 81 to 90% IACS, respectively.

On the other hand, both of an elongation (1.3%) and an electric conductivity (95% IACS) were good in the superfine copper alloy wire of comparative example 1. However, an Ag concentration in a copper alloy composition was 0.4 wt % which was less than the specified range (1.0 to 3.5 wt %) in the superfine copper alloy wire of comparative example 1. Since the Ag concentration was too low, it resulted in insufficient crystallization of eutectic crystal phases, so that a volume ratio of eutectic crystal phases became 0%. As a result, intensification due to the eutectic crystal phases could not be expected, whereby a tensile strength was 700 MPa which was less than the range specified (800 MPa or more).

On one hand, both of an elongation (1.3%) and an electric conductivity (88% IACS) were good in the superfine copper alloy wire of comparative example 2. However, the cooling rate was 500° C./min which exceeded the specified range (400 to less than 500° C./min) in the comparative example 2. Since the cooling rate was too fast, it resulted in insufficient crystallization of eutectic crystal phases, so that a volume ratio of eutectic crystal phases became 0.8%. As a result, intensification due to the eutectic crystal phases could not be expected, so that a tensile strength was 780 MPa which was less than the range specified (800 MPa or more).

Furthermore, a tensile strength (1300 MPa) was good in the superfine copper alloy wire of comparative example 3. However, an Ag concentration in a copper alloy composition was 5.0 wt % which exceeded the specified range in the superfine copper alloy wire of comparative example 3. Since the Ag concentration was too high, it resulted in an excessive volume ratio of 25% in eutectic crystal phases. As a result, an electric conductivity decreased to 72% IACS which was less than the range specified (80% IACS or more), and in addition, an elongation was also somewhat low of 1.0%.

According to the present invention, there is an excellent advantageous effect for obtaining a superfine copper alloy wire having a high tensile strength and high electric conductivity.

It will be appreciated by those of ordinary skill in the art that the present invention can be embodied in other specific forms without departing from the spirit or essential characteristics thereof.

The presently disclosed embodiments are therefore considered in all respects to be illustrative and not restrictive. The scope of the invention is indicated by the appended claims rather than the foregoing description, and all changes that come within the meaning and range of equivalents thereof are intended to be embraced therein.

What is claimed is:

1. A method for manufacturing a superfine copper alloy wire having a final wire diameter of 0.05 mm or less, said method comprising:

pouring a copper alloy hot metal consisting of 1.0 wt % or more to 3.5 wt % or less of Ag and a balance of a copper parent material having a total sum of 10 ppm or less of impurity concentrations into a casting mold to implement metal casting;

cooling an uncoagulated copper alloy hot metal after the pouring at a cooling rate of 400° C./min or more to 500° C./min or less to form a casting;

cold-working the casting for reducing a diameter thereof; and recrystallizing a wiredrawn material obtained as a result of the cold working.

2. The method for manufacturing a superfine copper alloy wire as defined in claim 1, wherein the recrystallizing comprises a heat treatment at a temperature of 300° C. or more to 550° C. or less for 0.5 to 20 hours.

3. The method for manufacturing a superfine copper alloy wire as defined in claim 2, wherein the wiredrawn material after the heat treatment is quenched.

4. A method for manufacturing a superfine copper alloy wire having a final wire diameter of 0.05 mm or less, said method comprising:

pouring a copper alloy hot metal consisting of 1.0 wt % or more to 3.5 wt % or less of Ag to contain in a copper parent material having a total sum of 10 ppm or less of impurity concentrations into a casting mold to implement metal casting;

cooling an uncoagulated copper alloy hot metal after the pouring at a cooling rate of 400° C./min or more to 500° C./min or less to form a casting;

cold-working the casting for reducing a diameter thereof; and recrystallizing a wiredrawn material obtained as a result of the cold working, wherein the recrystallizing comprises a rapid heating at a temperature of 600° C. or more to 900° C. or less for 5 to 120 seconds, and a quenching treatment is followed.

5. The method for manufacturing a superfine copper alloy wire as defined in claim 1, wherein a silver plating is applied to the wiredrawn material after the recrystallizing.

6. The method for manufacturing a superfine copper alloy wire as defined in claim 1, wherein said cooling comprises crystallizing eutectic crystal phases of Cu and Ag in a meshed form in a Cu matrix of the casting.

7. The method for manufacturing a superfine copper alloy wire as defined in claim 1, wherein in said cooling, a volume ratio of eutectic crystal phases of Cu and Ag is in a range of 3% to 20% with respect to an entire volume of the wire.

8. The method for manufacturing a superfine copper alloy wire as defined in claim 1, wherein a tensile strength of said wire is at least 800 MPa.

9. The method for manufacturing a superfine copper alloy wire as defined in claim 8, wherein an electric conductivity of said wire is at least 80% IACS (International Annealed Copper Standard).

* * * * *